US005992865A

United States Patent [19]

Vargas

[11] Patent Number: 5,992,865

[45] Date of Patent: Nov. 30, 1999

[54] DUAL IN-LINE SKATEBOARD WITH VARIABLE RATIO STEERING

[76] Inventor: Matthew Richard Vargas, 1499 El Oso Dr., San Jose, Calif. 95129

[21] Appl. No.: 08/885,262

[22] Filed: Jun. 30, 1997

[51] Int. Cl.[6] ..... A63C 17/01

[52] U.S. Cl. ..... 280/87.042; 280/87.04; 280/87.041

[58] Field of Search ..... 280/87.041, 87.042, 280/87.043, 87.01, 87.021, 11.27, 11.28

[56] References Cited

U.S. PATENT DOCUMENTS

| | | | |
|---|---|---|---|
| 4,062,557 | 12/1977 | Roden | 280/87.04 |
| 4,202,559 | 5/1980 | Piazza | 280/87.04 |
| 4,230,330 | 10/1980 | Muhammad | 280/87.04 |
| 5,236,208 | 8/1993 | Welsh | 280/87.041 |
| 5,263,725 | 11/1993 | Gesmer | 280/11.28 |
| 5,267,743 | 12/1993 | Smisek | 280/87.042 |
| 5,419,570 | 5/1995 | Bollotte | 280/87.041 |
| 5,474,314 | 12/1995 | Lehman | 280/87.042 |
| 5,549,331 | 8/1996 | Yun | 280/843 |
| 5,566,956 | 10/1996 | Wang | 280/7.14 |

*Primary Examiner*—Robert J. Oberleitner
*Assistant Examiner*—Daniel Yeagley

[57] ABSTRACT

A skateboard comprises a riding platform pivotably mounted to a substantially rigid chassis. The chassis mounts a plurality of wheels arranged in two substantially in-line rows. Embodiments have respectively four and five wheels in each row to redundantly support the weight of the rider. The advantages of the in-line roller skate are thus realized in this skateboard. The steerable wheels are mounted on bearings to individual wheel housings. The wheel housings are rotatably mounted within the chassis to allow steering. The housings are steered by a network of links within the chassis. Steering input to the linkage within the chassis originates from tilting of the riding platform from side to side. A steering arm mounted on the riding platform extends downward into the chassis engaging the steering linkage. A foot operated sliding actuator mounted on the top of the riding platform varies the angle of engagement of the steering arm with the steering linkage. This allows the rider to adjust the overall steering ratio on the fly. Changing the steering ratio for different speeds allows the rider to take full advantage of the steering capabilities of the skateboard. A skateboard results which is faster, smoother-riding, and more maneuverable than existing skateboard designs.

20 Claims, 15 Drawing Sheets

DUAL IN-LINE SKATEBOARD WITH VARIABLE RATIO STEERING

BACKGROUND—FIELD OF THE INVENTION

This invention relates to skateboards, specifically to the wheeled suspension and mechanized steering of a skateboard device.

BACKGROUND—DISCUSSION OF PRIOR ART

Conventional skateboards have a riding platform, called a deck, and two wheeled mechanisms known as trucks. The trucks are mounted to the underside of the deck with one in front and one in back. Each truck has two wheels mounted to a rigid shaft on bearings. The shaft is mounted to the deck such that tilting of the deck in relation to the trucks results in a pivoting of the shafts. The shafts pivot such that a stable mechanism for steering and balancing results.

This design is decades old and has some inherent disadvantages limiting speed, smoothness of ride, and maneuverability. By design, each of the four wheels shares equally the load of the riders weight. When the skateboard passes over a crack in the riding surface, such as the grooves of a sidewalk, each wheel in turn falls into the crack. This is very inefficient when speed is desired. Additionally, because there are only four small wheels supporting the weight of the rider, each wheel must be relatively hard to resist wear. This makes for a very rough ride even on slightly bumpy surfaces. Finally, the steering ratio is fixed regardless of speed.

The amount that the skateboard is steered for a given degree of tilt is called the steering ratio. A quick or responsive ratio results in a relatively small or tight turning circle. A less responsive ratio results in a larger or wider turn. The steering ratio has a direct result on skateboard stability. At relatively low speeds it is desirable to have relatively quick steering. This improves stability and allows the rider to maneuver the skateboard in tight turns. Because the rider is traveling relatively slowly it is possible for him to shift his weight to accommodate the turn. At higher speeds the rider experiences increasing difficulty in shifting his weight quickly enough. At these speeds the rider doesn't have time to react to a sharp turn. If the steering ratio is too quick, the rider will not be able to balance and the steering is unstable.

At low speeds a ratio that is not quick enough is equally undesirable. If the rider feels himself falling to one side, he immediately steers the skateboard to balance himself. A relatively unresponsive ratio will not steer the skateboard adequately to correct the rider's imbalance. In fact, a particular ratio is ideally suited to just a single speed and is stable for only a range of speeds. A single steering ratio is at best a compromise and cannot be ideally suited for all speeds. A provision to vary the steering ratio of the skateboard is valuable to take better advantage of the skateboard's turning capabilities and is especially useful for a skateboard that can attain high speeds. Conventional skateboards have no such provision. It is clear that conventional skateboards are slow, rough-riding, and compromise maneuverability.

The recent popularity of in-line roller-skating has made obvious the inherent advantages of the in-line skate. The design of the in-line skate features several (usually four) wheels mounted to a rigid frame or blade along an axis parallel to the direction of travel. This in-line skate is then mounted to a skating boot. The points of contact of the wheels on the riding surface lie on a single line. Since only two points are required to describe a line, the rider's weight is redundantly supported and not necessarily equally distributed among the wheels. The actual load on each wheel depends not only on the weight of the rider but on the riding surface as well. For example, when an in-line skate passes over a crack in the riding surface the leading wheel is suspended over the crack while the remaining wheels support the weight of the rider. Similarly each wheel in turn is suspended over the crack while the others carry the load of the skater's weight. None of the wheels actually falls into the crack. This is a great advantage and improves both speed and ride smoothness.

In-line skates offer other potential advantages. Because there are more wheels to support the weight of the rider, each wheel carries a lesser load on average. This allows the use of softer wheels without sacrificing wear resistance. The softer wheels absorb irregularities in the riding surface more easily than hard wheels. This further improves ride smoothness. Additionally, the use of narrow rounded (or crowned) wheels, common for most in-line roller skates, is another improvement. The rounded surface tends to push aside small rocks and debris which broad flat wheels, such as those on conventional skateboards, tend to roll over. With these advantages it is no wonder that in-line skating has become very popular.

Attempts have been made to apply the advantages of the in-line skate to the skateboard. U.S. Pat. No. 5,419,570 describes a skateboard design with a single row of rigidly-mounted, in-line wheels on the underside of a deck. While this arrangement would likely display the basic advantages of the in-line skate, there is no provision for a stable method of steering. The difficulty of steering and balancing such a device renders the potential advantages of speed and ride smoothness inconsequential. One might imagine a skateboard with two adjacent rows of in-line wheels. Such an arrangement would tend not to tip over, but the problem of steering is still present. The importance of steering cannot be over-stressed. U.S. Pat. No. 5,263,725 describes the steering needs of the skateboard rider very well. In addition to the rider's needs there is also a mechanical need which must be met. The wheels of the skateboard must be steered such that they all tend to travel about substantially the same point. The section on theory of operation discusses this mechanical steering requirement further.

U.S. Pat. No. 4,062,557 shows an eight-wheeled skateboard. While this design might allow the use of softer wheels, the rider's weight is still equally distributed among the wheels, and the steering mechanism is not improved over the conventional skateboard. In fact, the proposed steering method is flawed as well. For any given turning radius all eight wheels do not turn about the same point. The leading and trailing axles tend to turn wider than the intermediate axles. This leads to excessive wheel wear and is generally inefficient. Once again steering is a problem.

U.S. Pat. No. 5,236,208 shows a skateboard with a chassis, four wheels, and two swiveling platforms. The front platform steers the front pair of wheels and the rear platform steers the rear pair. Both platforms require a twisting motion (rotation on a vertical axis) by the foot of the rider for steering. This device is more difficult to ride because the twisting motion required for steering is not as stable as conventional tilting methods. Also, like the previous device, the steering is inconsistent. The steering mechanism fails to steer the wheels around substantially the same point. The steering of this skateboard fails both by the method chosen and the mechanism used.

OBJECTS AND ADVANTAGES

Several objects and advantages of the present invention are:

(a) to provide a skateboard which is faster than conventional skateboards.

(b) to provide a skateboard which is smoother riding than existing skateboards.

(c) to provide a skateboard steering system which allows more maneuverability than conventional systems.

(d) to provide a skateboard steering system which allows stable balancing at different speeds.

(e) to provide a multi-wheeled steering system that steers each wheel such that they all travel about substantially the same center of turn to minimize rolling resistance.

Further objects and advantages of the invention will become apparent from consideration of the drawings and ensuing description.

LIST OF REFERENCE NUMERALS

Figure 1:
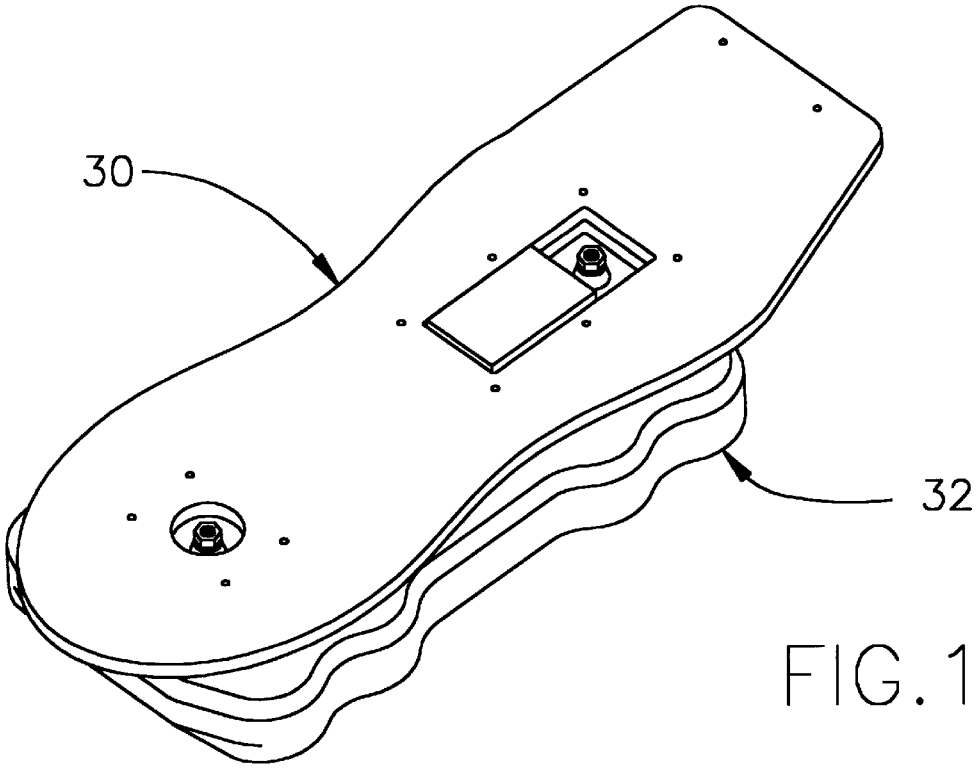
FIG. 1 shows an isometric top view of the skateboard.

30 riding platform
32 chassis
34 variable ratio steering unit
36 steering linkage
38 ten-wheeled chassis
40 mounting bolts
42 lower washers
44 lower bushings
46 upper bushings
48 upper washers
50 mounting nuts
52 screws
54 deck
56 front mounting plate
58 nuts
60 break pads
62 foot actuator
64 rear mounting plate
66 reducing gear
68 pinion
70 steering arm
72 slider
74*a* left pillow block
74*b* right pillow block
76 screws
78 gear rack
80 upper shell
82 lower shell
84 screws
86*a–h* wheel housings
87*a–h* cylindrical appendages
88*a–h* connecting links
90*a* front input link
90*b* rear input link
92 transfer link
94 catch
96 wheel
98 bearing
100 spacer
102 screw
104 washer
106 wheel housing gasket
108 rear mounting plate with fixed ratio steering arm
110 deck for fixed ratio steering
112 fixed ratio steering arm

SUMMARY

In accordance with the present invention a skateboard has two rows of in-line wheels, each row located adjacent to an edge of the skateboard opposite the row of wheels adjacent to the opposite edge. The skateboard has a riding platform pivotably mounted to a substantially rigid chassis. Each wheel is independently mounted in a housing which is rotatably mounted on the underside of the chassis. The axis of rotation of the wheel housing is substantially perpendicular to the chassis. The rider steers the skateboard by tilting the platform. He selects the steering ratio by positioning a sliding actuator on the platform with his foot while he is riding the skateboard. The adjustable steering ratio capability is a major feature of the invention and is an improvement over the prior art in which the steering ratio is fixed.

DESCRIPTION OF THE INVENTION

Figure 2:
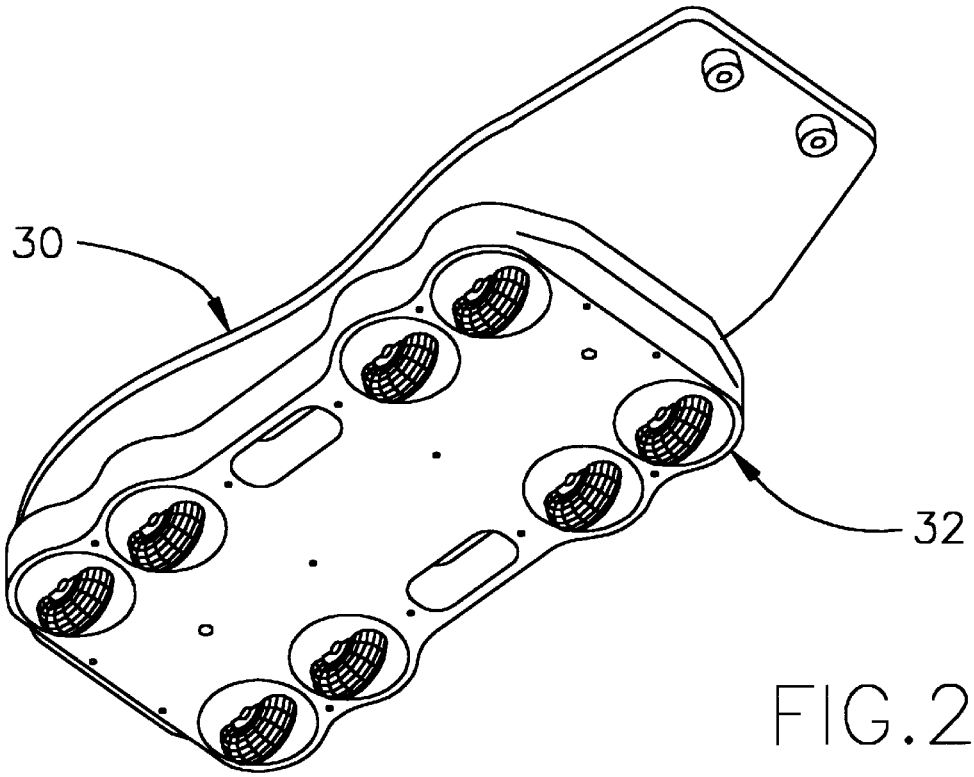
FIG. 2 shows an isometric bottom view of the skateboard.
Figure 3:
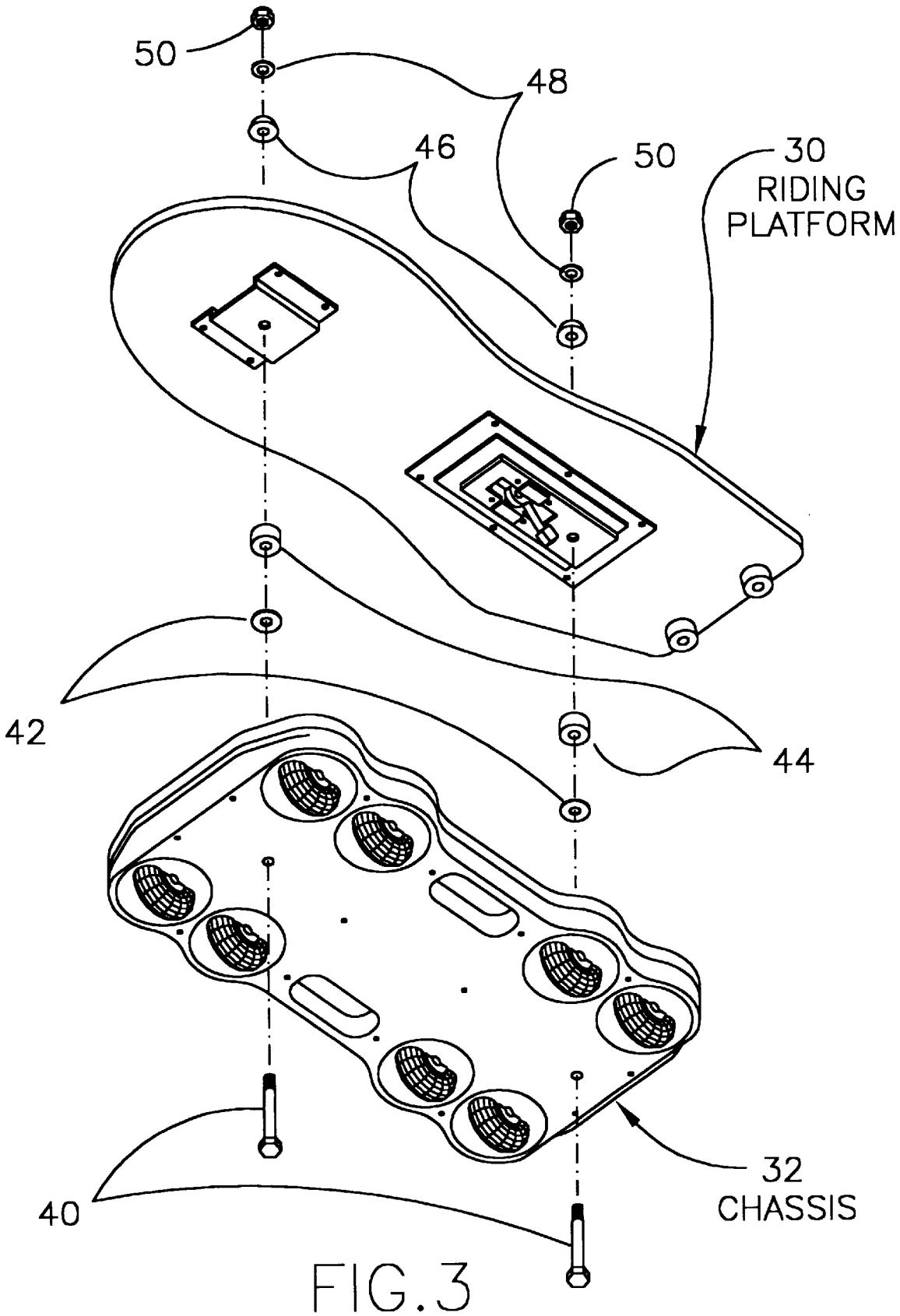
FIG. 3 shows an exploded view of the skateboard revealing the riding platform and chassis.

The preferred embodiment of the invention is shown in perspective in FIG. 1 and FIG. 2 and partially exploded in FIG. 3. Referring to FIG. 3 a riding platform 30 is mounted to a chassis 32. Bolts 40 insert through chassis 32, lower washers 42, lower bushings 44, riding platform 30, upper bushings 46, and upper washers 48 to engage nuts 50. This mounting is shown in cross-section in FIG. 6. Bushings 44 and 46 are comparable to bushings used in conventional skateboard trucks and are composed of a resilient material such as urethane rubber.

Figure 4:
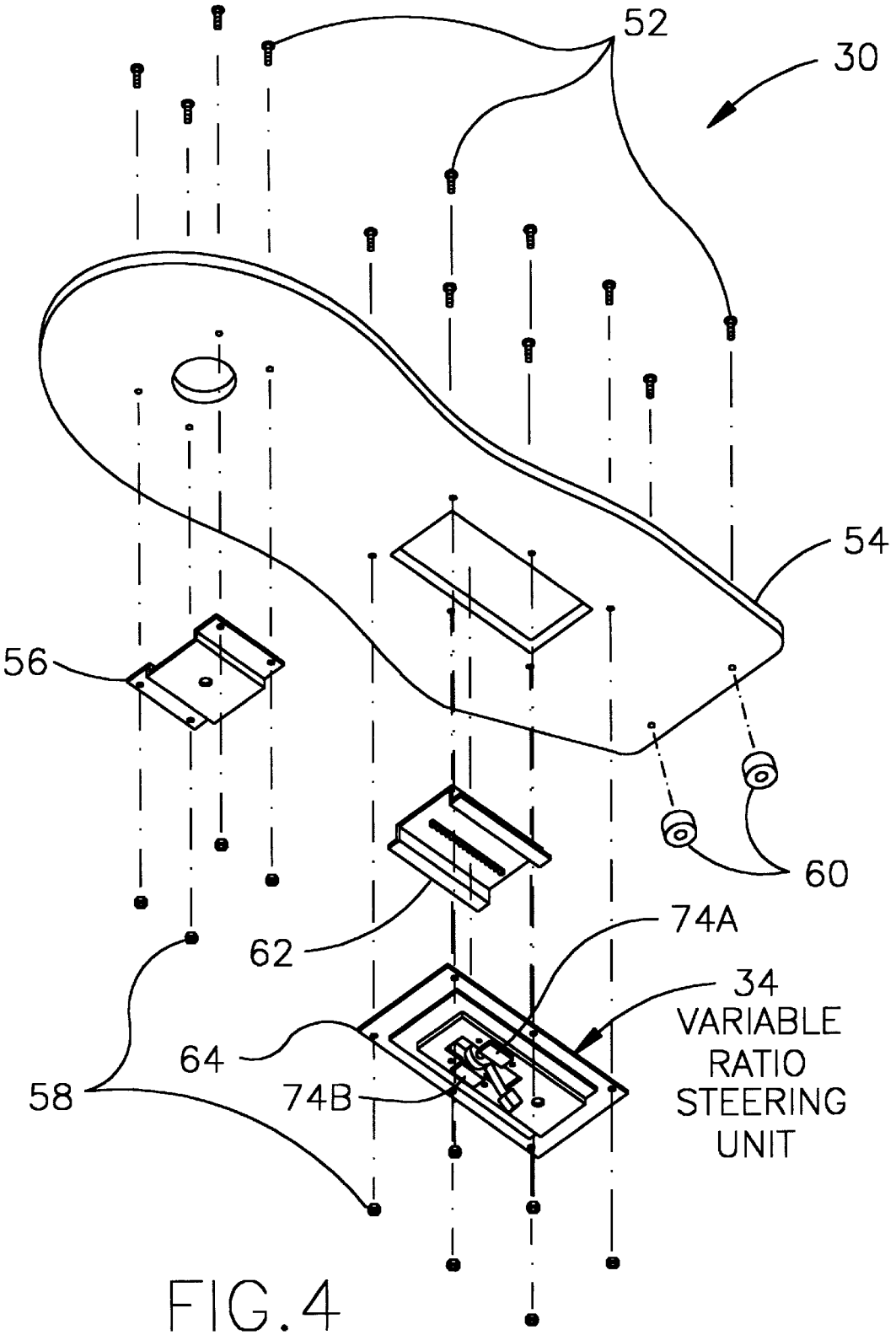
FIG. 4 shows and exploded view of the riding platform revealing the variable ratio steering unit.

FIG. 4 shows an exploded view of riding platform 30. Screws 52 insert through a board or deck 54 and a front mounting plate 56 to engage nuts 58. The front mounting plate is thus rigidly mounted to the deck and is preferably constructed from a durable material such as aluminum. Plate 56 provides the contacting surface to bushings 44 and 46. Screws 52 also insert through deck 54 and a variable steering unit 34 to engage nuts 58. A foot actuator 62 is retained in unit 34 by deck 54 and rests in a recess of a rear mounting plate 64. Holes in deck 54 allows access to nuts 50 and actuator 62. Deck 54 is constructed of a comparable material to conventional skateboard decks such as a seven-ply wood laminate. The composition of plate 64 is similar to that of plate 56. Actuator 62 may be constructed of a die cast metal or injection molded polymer. Break pads 60 mount to deck 54 with screws 52. The pads are composed of a material such as vulcanized rubber.

Figure 5:
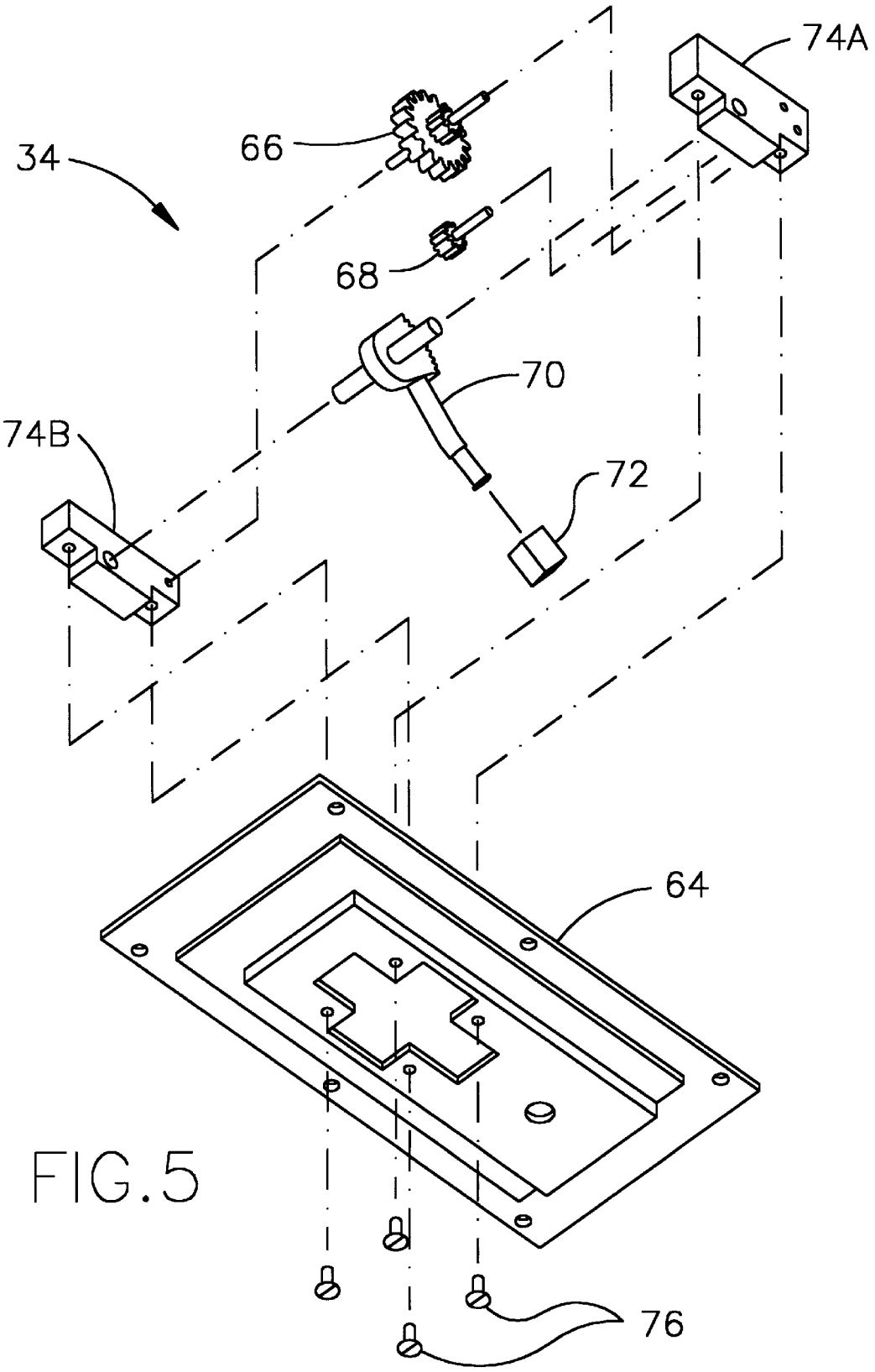
FIG. 5 shows an exploded view of the variable ratio steering unit.

FIG. 5 shows an exploded view of unit 34. A reducing gear 66 engages a pinion 68 which in turn engages a steering arm 70. The gear, pinion and arm are pivotably supported by a left pillow block 74*a* and a right pillow block 74*b*. Blocks 74*a* and 74*b* are mounted to plate 64 with screws 76. A slider 72 is pivotably attached to arm 70 and is shown in greater detail in FIG. 8. Slider 72 and blocks 74*a* and 74*b* are composed of a durable, lubricious polymer such as acetal resin.

Figure 7:
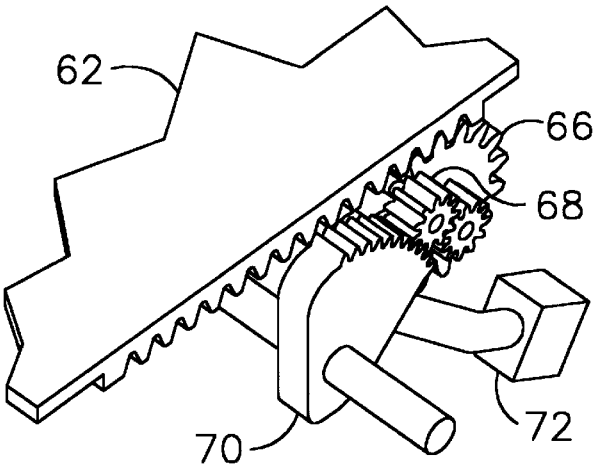
FIG. 7 shows an isometric cut-away of the variable ratio steering unit.
Figure 6:
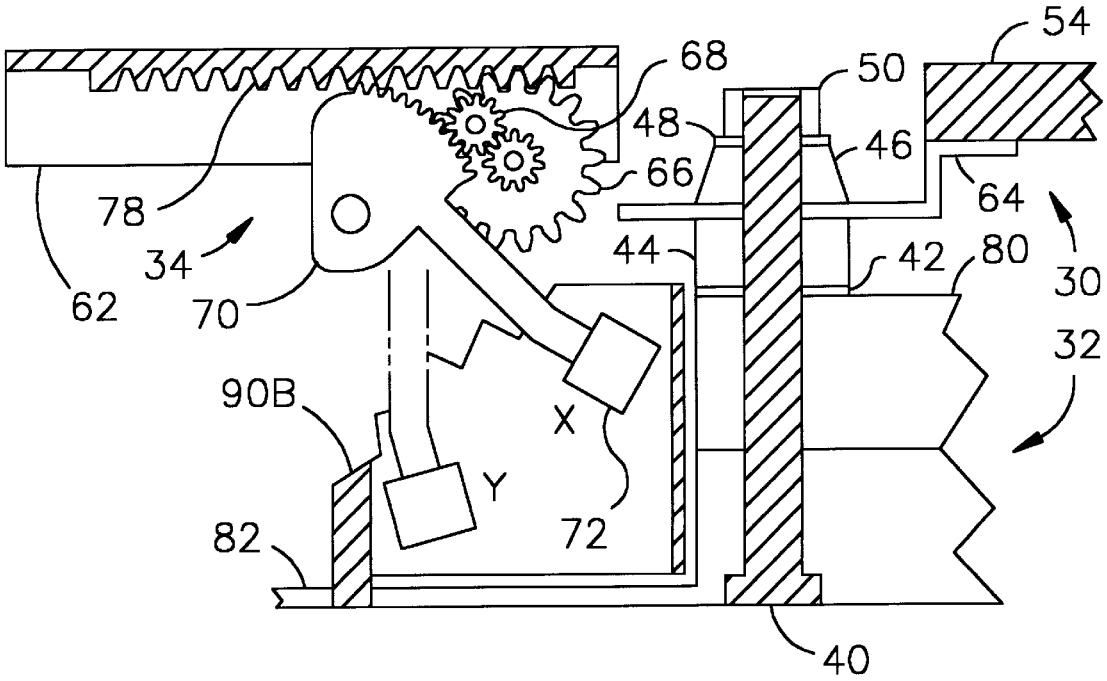
FIG. 6 shows a side view of the variable ratio steering unit.

Referring to FIGS. 6 and 7 a gear rack 78 is an integral feature on the underside of actuator 62. Rack 78 engages the large diameter of gear 66. The small diameter of gear 66 engages pinion 68 which in turn engages arm 70. FIG. 6 also shows a sectional side view of the assembled rear mounting of chassis 32 to platform 30. This mounting is shown exploded in FIG. 3 and is included in FIG. 6 to show its position relative to unit 34 and chassis 32.

Figure 9:
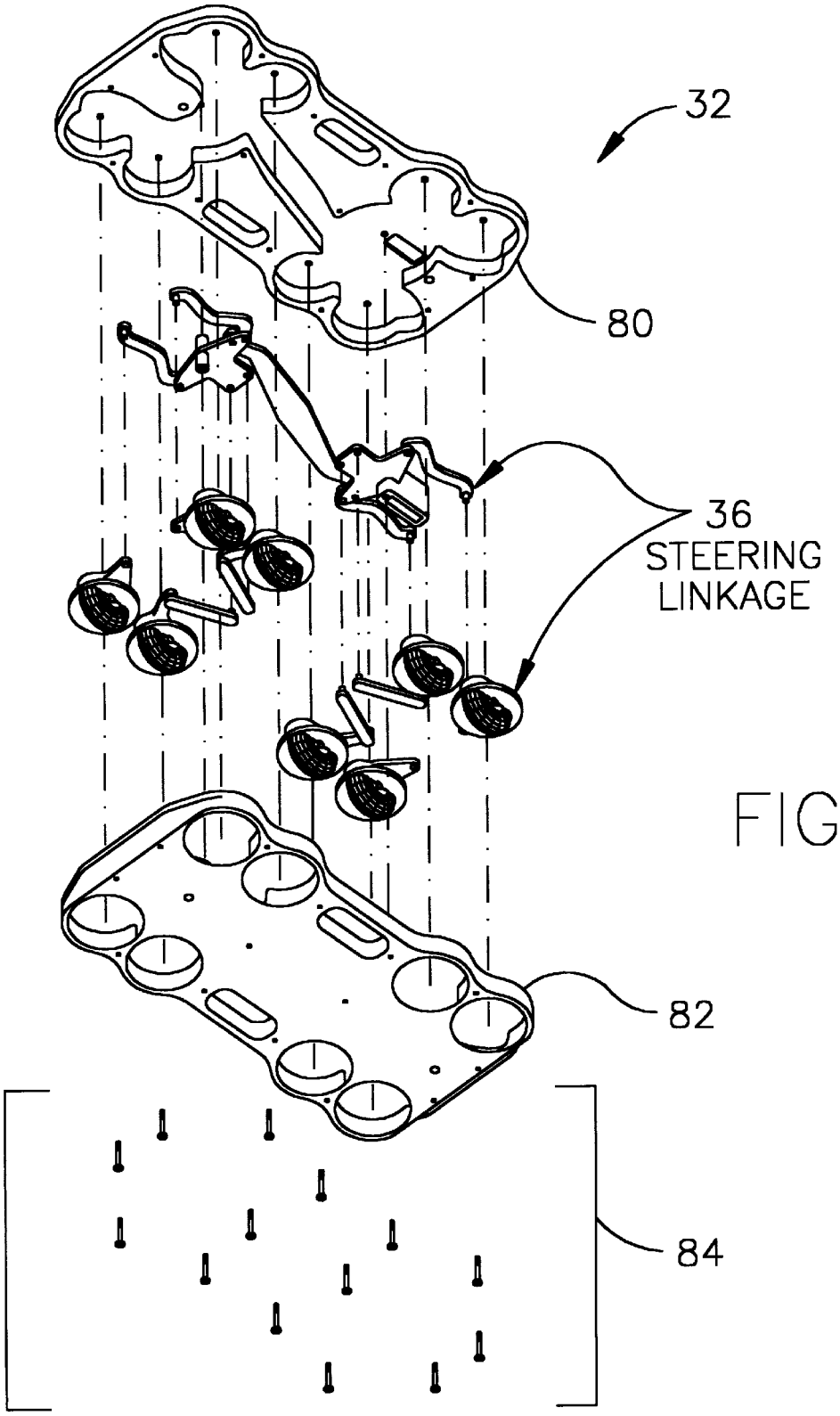
FIG. 9 shows an exploded view of the chassis revealing the steering linkage.
Figure 10:
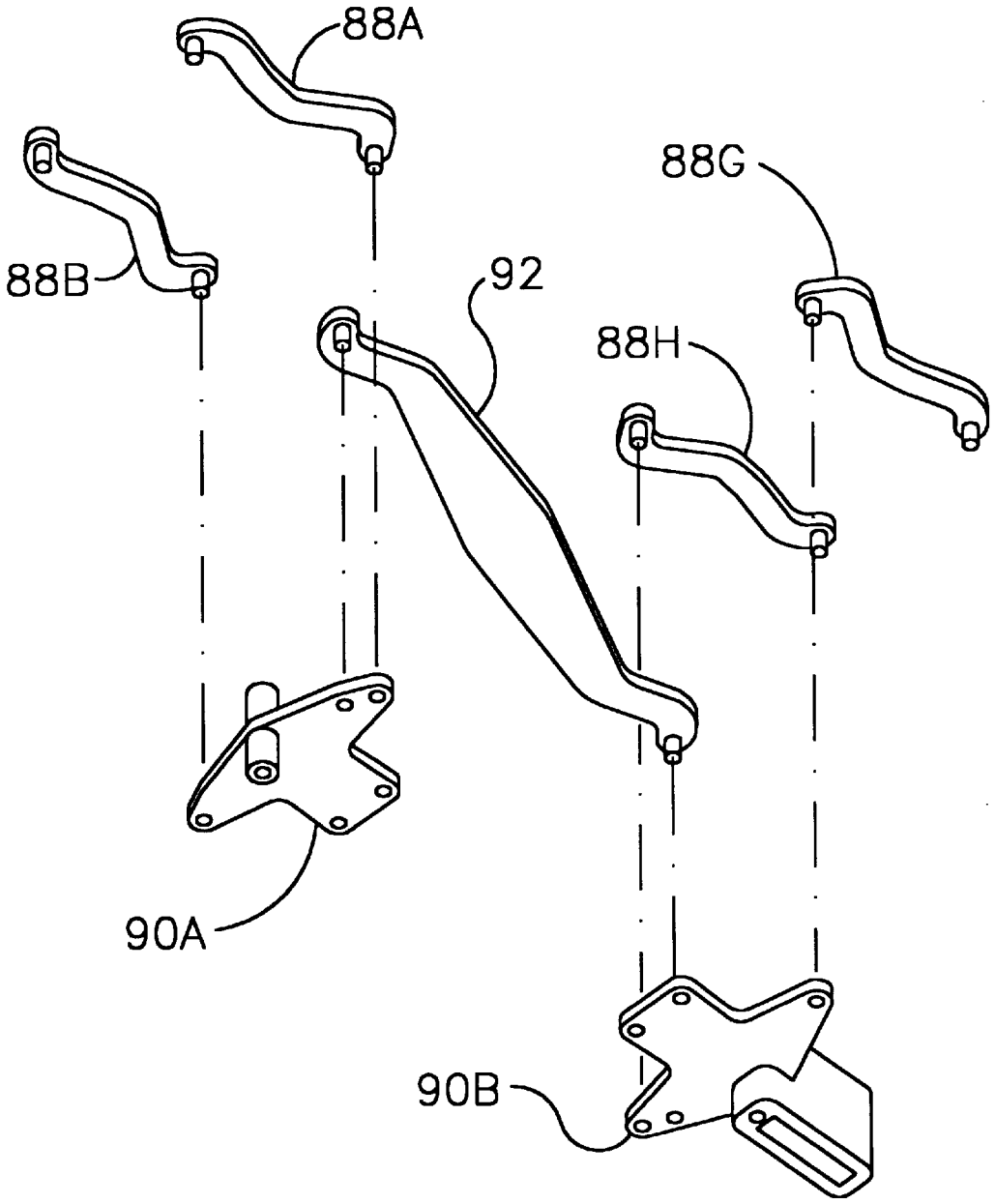
FIG. 10 shows an exploded view of a portion of the steering linkage.
Figure 11:
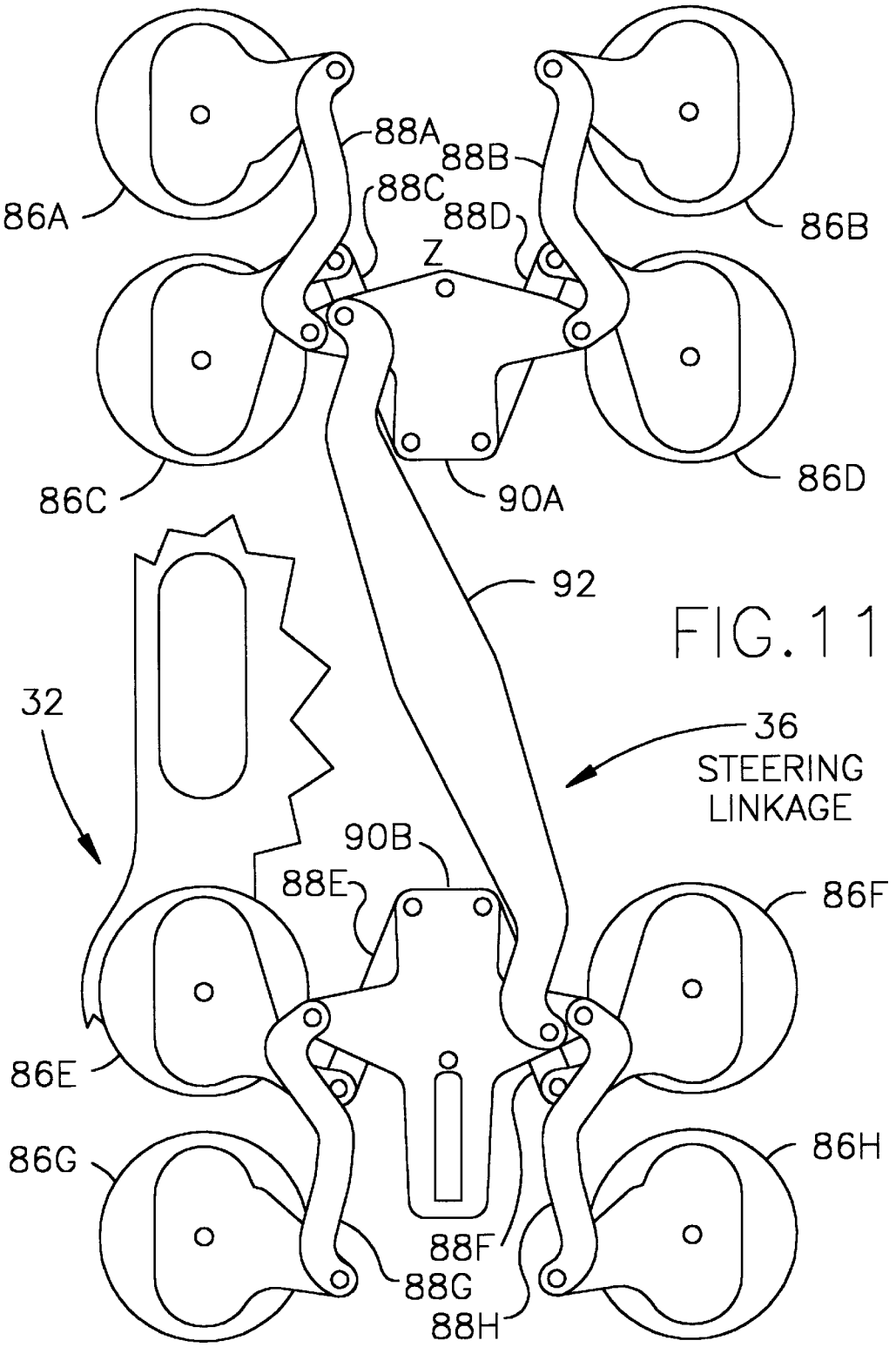
FIG. 11 shows a plan view of the steering linkage.

FIG. 9 shows an exploded view of chassis 32. An upper shell 80 mounts to a lower shell 82 with mounting screws 84. Shells 80 and 82 capture a steering linkage 36 and are molded from a substantially rigid material such as a fiber reinforced thermoplastic resin. Referring to FIG. 11 linkage 36 comprises wheel housings 86*a–h*, connecting links 88*a–h*, a front input link 90*a*, a rear input link 90*b*, and a transfer link 92. FIG. 10 shows an exploded view of part of linkage 36, and FIG. 11 shows a plan view of the linkage. There are eight steered wheels in this configuration and thus eight wheel housings. Housings 86*a–h* and links 90*a* and 90*b* are pivotably mounted in chassis 32. Link 88*a* pivotably connects housing 86*a* to link 90*a*. Similarly, links 88*b–d* pivotably connect housings 86*b–d* to link 90*a*. Link 88*e* pivotably connects housing 88*e* to link 90*b*. Similarly, links 88*f–h* pivotably connect housings 86*f–h* to link 90*b*. Link 92 pivotably connects link 90*a* to link 90*b*. The components of linkage 36 are generally molded from a thermoplastic material.

Linkage 36 is symmetric in nature. The linkage comprising chassis 32, links 90*a* and 88*a–d*, and housings 86*a–d* is effectively a mirror image of the linkage comprising chassis 32, links 90*b* and 88*e–h*, and housings 86*e–h*. Additionally, the linkage shown in schematic form in [FIG. 12] comprising chassis 32, links 90*a*, 88*a*, and 88*c*, and housings 86*a* and 86*c* is effectively a mirror image of the linkage comprising chassis 32, links 90*a*, 88*b*, and 88*d*, and housings 86*b* and 86*d*. Similarly, the linkage comprising chassis 32, links 90*b*, 88*e*, and 88*g*, and housings 86*e* and 86*g* is effectively a mirror image of the linkage comprising chassis 32, links 90*b*, 88*f*, and 88*h*, and housings 86*f* and 86*h*. The linkage comprising chassis 32 and links 90*a–b* and 92 is unique and is shown schematically in FIG. 13. Thus the schematic drawings of FIGS. 12 and 13 sufficiently describe the geometry of linkage 36.

Figures 12, 13:
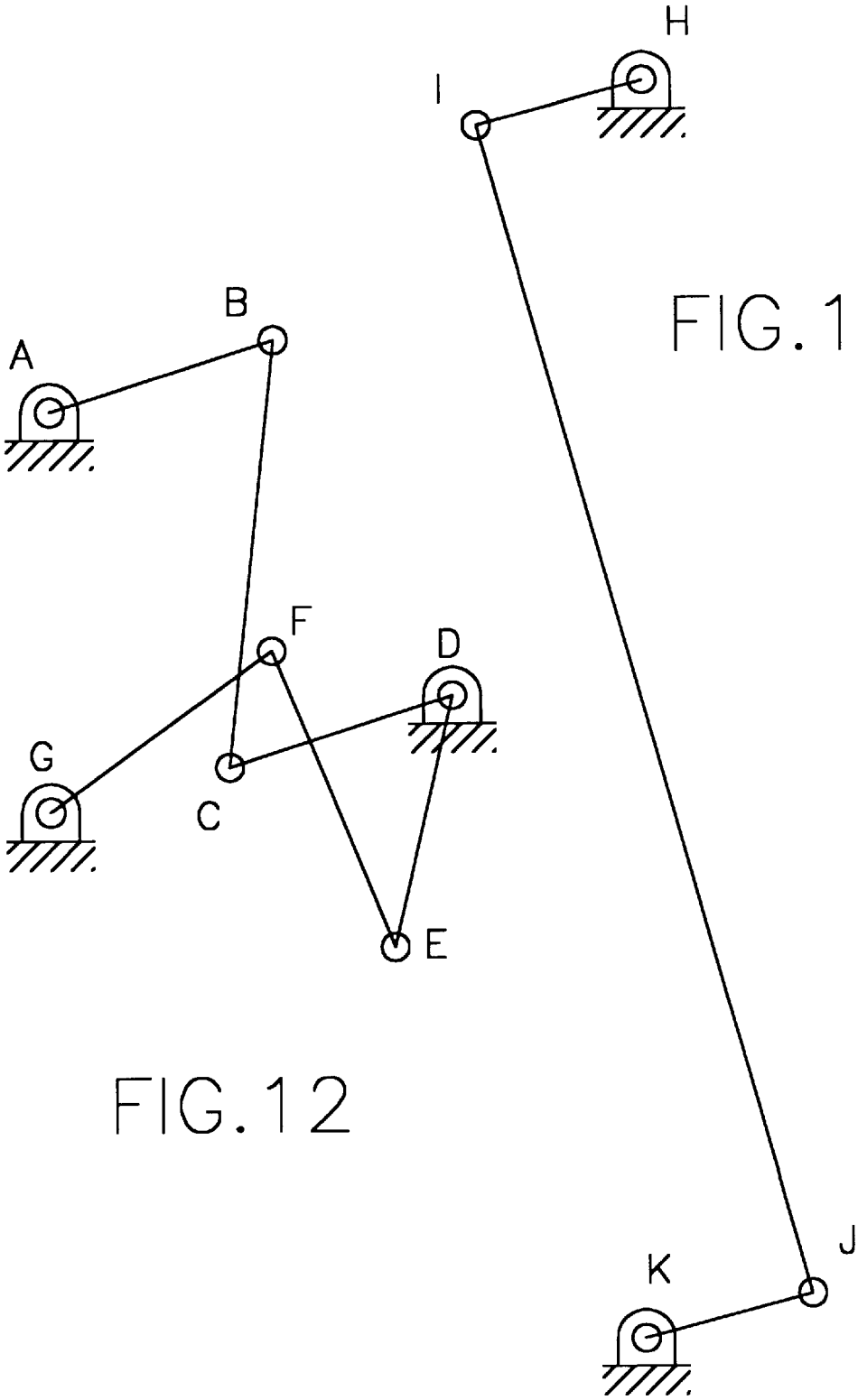
FIG. 12 shows a schematic of the symmetric portion of the steering linkage.
FIG. 13 shows a schematic of the portion of the steering linkage that connects the front and rear sections of the linkage.

The geometry of the steering linkage is important to ensure proper steering of the wheels. This will be discussed in greater detail in the section on theory of operation. Referring to FIGS. 12 and 13 knowledge of the lengths of the various line segments, which represent links in the steering linkage, is required to accurately replicate the design. Other linkage configurations may give comparable results, and the following dimensions are given as one effective solution to the steering problem. The segments are designated by their respective endpoints according to standard geometric notation and have the following lengths:

AB 5.182 cm
BC 9.551 cm
CD 5.182 cm
AD 10.925 cm
DE 5.702 cm
EF 7.112 cm
FG 6.045 cm
DG 9.246 cm
AG 8.890 cm
HI 3.810 cm
IJ 26.991 cm
JK 3.810 cm
HK 27.940 cm

The foregoing dimensions may be scaled with a common multiplier without altering the steering characteristics. In other words the skateboard can be made larger or smaller than the given dimensions indicate. The orientation of the schematic representations shown in FIGS. 12 and 13 corresponds with the orientation of linkage 36 as shown in FIG. 11. With this orientation line segments AG and HK are on the vertical of the page. Point D of FIG. 12 and point H of FIG. 13 represent the same pivot point Z of FIG. 11 in linkage 36. They are given separate letter designators in the schematic because FIG. 12 actually represents four different sections of the steering linkage. This is possible due to the symmetry discussed earlier.

Figure 14:
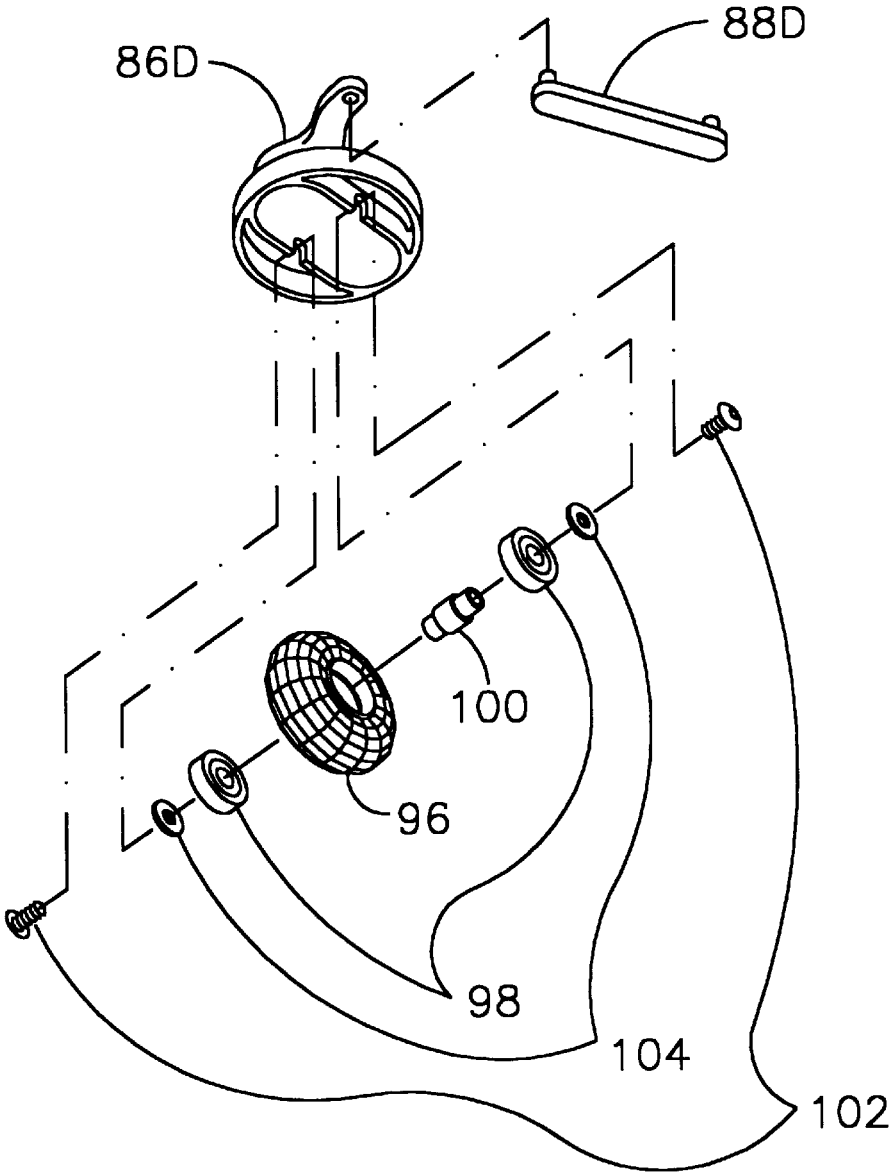
FIG. 14 shows an exploded view of a typical wheel mounting.
Figure 15:
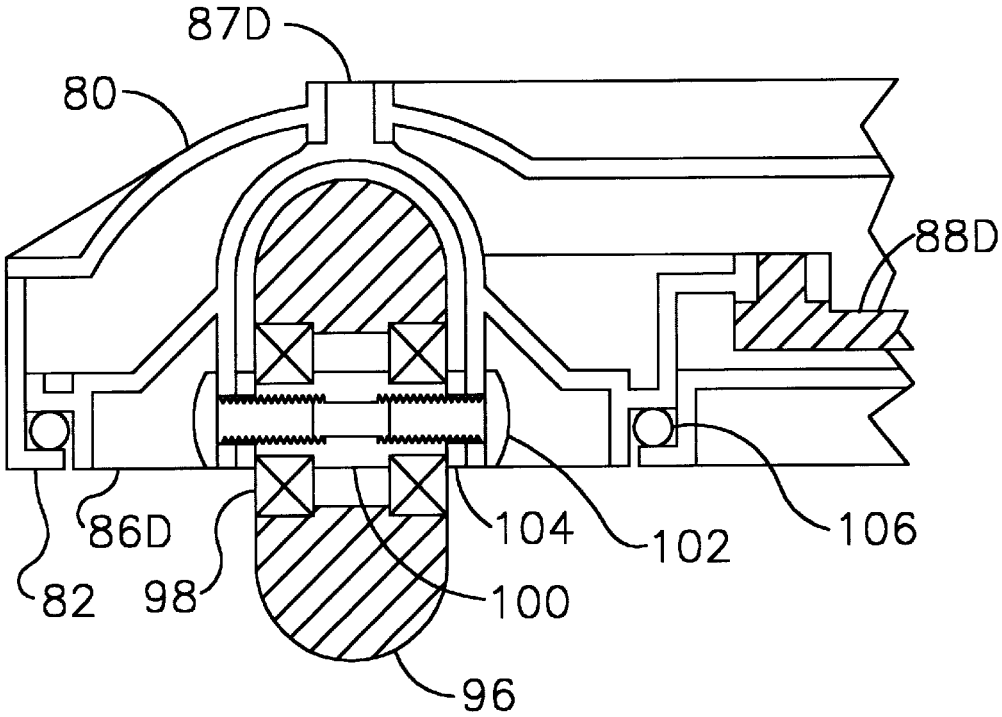
FIG. 15 shows a cross-sectional end view of a typical wheel mounted in the chassis.

FIG. 14 shows an exploded view of parts mounted to wheel housing 86*d*, and FIG. 15 shows the assembled parts in cross-section. Both figures show mounting which is typical to all eight wheel housings. Referring to FIG. 14 bearings 98 are pressed into a wheel 96 capturing a threaded spacer 100. Screws 102 insert through slots in housing 86*d* and washers 104 to engage spacer 100. The wheel, bearings, and related hardware are comparable to similar parts used in in-line roller skates.

Referring to FIG. 15 housing 86*d* is captured by shells 80 and 82. A cylindrical appendage 87*d* on the upper surface of the wheel housing inserts into a corresponding circular hole in the upper shell. Housing 86*d* rests on a gasket 106 which is mounted in a circular recess of shell 82. A circular hole in shell 82 is concentric with the gasket and allows wheel 96 to protrude beyond the lower surface of shell 82 to contact the riding surface. The remaining wheel housings are pivotably retained in the chassis in a substantially similar manner. Gaskets 106 are compressible and have a lubricious surface. A suitable composition is that of an expanded material such as expanded urethane rubber coated with a lubricious film such as PTFE. The cross-section of gasket 106 is shown as circular but may have an alternate shape such as that of a square or rectangle.

Figure 16:
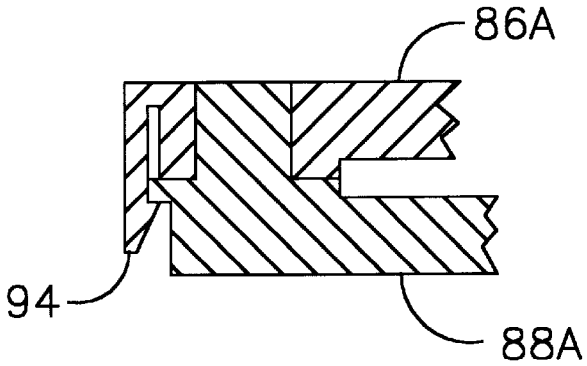
FIG. 16 shows a cross-sectional detail of a typical joint attachment for the links of the steering linkage.

FIG. 16 shows a detail of the joint between link 88*a* and wheel housing 86*a*. This is a typical joint connection among the links of linkage 36. The joint comprises a cylindrical protuberance on link 88*a* which fits into a cylindrical hole in housing 86*a*. The joint is held together by a catch 94 which is an integral feature of housing 86*a*. A snap-fit joint results which allows pivoting of one link in relation to another.

Operation

A skateboard rider stands on riding platform 30 in substantially the same manner as he would stand on a conventional skateboard. A common foot placement has one foot toward the front of the platform, and the other toward the rear. Forward propulsion is generally accomplished by leaving one foot on the platform while the other foot pushes against the riding surface. The skateboard is steered in much the same way a conventional skateboard is steered: by tilting the platform from side to side. The rider shifts his weight toward the right edge of the platform to turn right and toward the left edge to turn left. The rider balances on the platform by leaning into turns and turning in the direction of impending falls as would the rider of a bicycle. The steering method described above allows this to be possible, and a stable relationship between steering and balancing results. When breaking is desired the rider shifts his weight to the back of the platform lifting the front of the skateboard off the ground allowing break pads 60 to rub against the riding surface. The rider may carry the skateboard using pockets on the underside of chassis 32 as handles.

The tilting motion of platform 30 is allowed by deformation of bushings 44 and 46 shown in FIG. 3. Washers 42 and 48 provide a relatively hard surface to contact the bushings. Plates 56 and 64 are captured by the bushings. These plates are mounted to deck 54 as shown in FIG. 4. As the rider shifts his weight on the deck to execute a turn plates 56 and 64 tilt between the bushings. The bushings resist the ensuing deformation by providing a restoring force on the plates. When the rider shifts his weight to a neutral or centered position, the bushings assist the platform to return to its neutral state. Bolts 40 hold platform 30 to chassis 32 and compress the bushings with nuts 50. The nuts can be used to adjust the static compression of the bushings which results in changing the relative effort the rider uses to tilt the platform.

Figure 8:
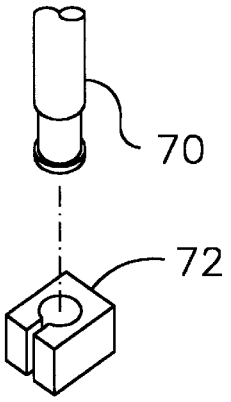
FIG. 8 shows a detail of two of the components of the variable ratio steering unit.

In addition to providing an attachment location on the riding platform for mounting to the chassis, rear mounting plate 64 also provides attachment locations for components of variable steering unit 34. Referring to FIG. 5 a cross-shaped hole in plate 64 allows arm 70 to protrude downward into the chassis. Pillow blocks 74*a* and 74*b* mount on plate 64 and provide pivotal mounting of gear 66, pinion 68, and arm 70. Shafts on the gear, pinion, and arm mount in holes in the pillow blocks to allow rotational motion. Slider 72 pivots on the end of arm 70. Referring to FIG. 8 a slit in the slider allows it to snap into place on a narrowed diameter at the end of arm 70. Foot actuator 62 rests in a recess on the top of plate 64 and slides back and forth engaging gear 66 with rack 78. Actuator 62, together with the variable steering unit, tilt with the riding platform. By sliding foot actuator 62 back and forth the rider is able to adjust the steering ratio on the fly (while the skateboard is in motion).

Referring to FIG. 6 rack 78 of foot actuator 62 engages the large diameter of gear 66. As the actuator is pressed rearward (to the right in FIG. 6) gear 66 rotates clockwise. The small diameter of gear 66 engages pinion 68 which causes it to rotate counter clockwise. Pinion 68 engages arm 70 causing it to rotate clockwise or downward. Slider 72, which is pivotably mounted to the arm, moves from position X to position Y in FIG. 6. Slider 72 is the element that transfers motion from platform 30 to steering linkage 36 in chassis 32. Slider 72 travels within the slot of rear input link 90*b* of linkage 36. The amount of steering is proportional to the rotation of link 90*b*. As platform 30 tilts, slider 72 moves from side to side. This motion in position X is relatively far from the pivot axis of link 90*b* and results in relatively small rotational motion of the link. The motion of slider 72 in position Y, however, is much closer to the pivot axis of link 90*b* and results in a much greater rotation of that link. As a result, when actuator 62 is pushed back the effective steering ratio becomes more responsive allowing tighter turns at lower speeds. When the actuator is moved forward the ratio becomes less responsive allowing greater stability at higher speeds.

The motion of rear input link 90*b* is transferred through linkage 36 to steer the wheels. Referring to FIG. 11 link 92 transfers motion from link 90*b* to link 90*a*. Links 88*a–d* transfer motion from link 90*a* to wheel housings 86*a–d* respectively. Similarly, links 88*e–h* transfer motion from link 90*b* to wheel housings 86*e–h* respectively. Wheels 96 are mounted to wheel housings 86*a–h* and are therefore steered by linkage 36 which transfers motion from platform 30. Referring to FIGS. 14 and 15 bearings 98 allow wheel 96 to rotate freely on spacer 100. Spacer 100 provides a substantially rigid support for wheel 96 when mounted to housing 86*d* with screws 102 and washers 104. Washers 104 provide clearance between wheel 96 and housing 86*d*. Gasket 106 keeps the wheel housings engaged in upper shell 80 and serves as a barrier to dust and contaminants which might enter the void created by shells 80 and 82 in which linkage 36 lies. Thus the gaskets provide substantially compliant support for the wheel housing and shield linkage 36 from dirt and debris.

Theory of Operation

Steering a multi-wheeled vehicle requires that all the wheels roll about substantially the same center of turn. That is to say that the lines drawn through the projection of the rotation axes of each wheel onto the plane of the riding surface would intersect in substantially the same point, the center of turn. If this were not true, then the wheels would do one of two things. First the wheels might travel away from each other. This is not likely since the wheels are presumably constrained in motion by the vehicle itself. Alternately, and more likely, some or all of the wheels would scuff or slide against the riding surface. This is not generally desirable since it leads to excessive tread wear and inefficient use of the energy used to propel the vehicle.

Figure 17:
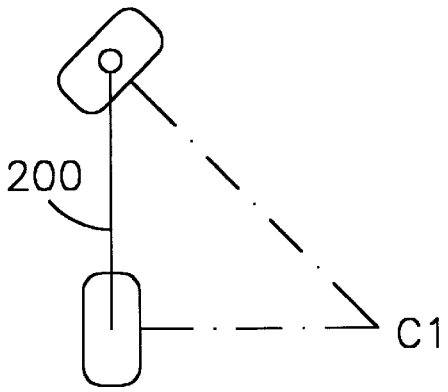
FIG. 17 shows the steering of a two-wheeled vehicle.
Figure 18:
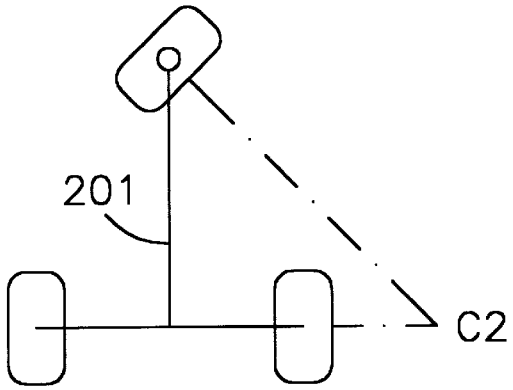
FIG. 18 shows the steering of a three-wheeled vehicle.

Meeting this requirement in a two wheeled vehicle is generally automatic. Referring to FIG. 17 the two lines drawn through the rotation axes of the two wheels of vehicle schematic 200 will intersect at point C1 based on basic principles of geometry. The steering system for a three wheeled vehicle, such as a tricycle, is almost as easily designed. Referring to FIG. 18 if two of the wheels of vehicle schematic 201 share a common axis of rotation and the third wheel is the only steered wheel, then the geometry becomes identical to the two wheeled case described above. The lines intersect at point C2. For four wheeled vehicles steering analysis is more involved.

Figure 19:
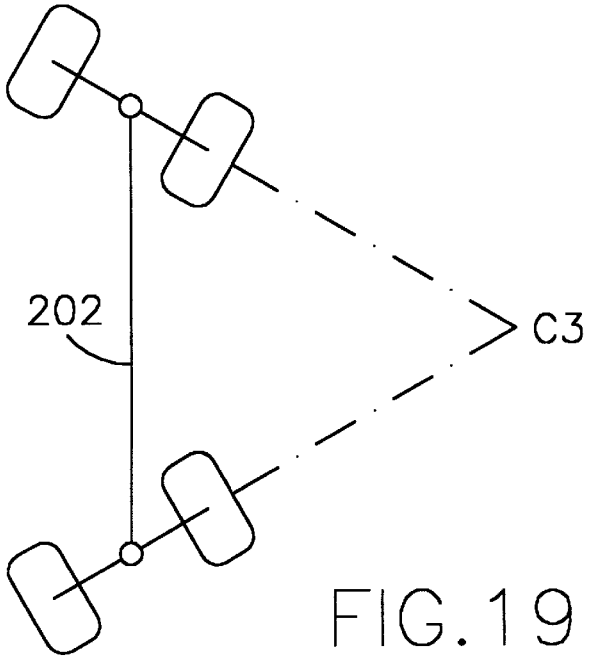
FIG. 19 shows the steering of a conventional skateboard.
Figure 20:
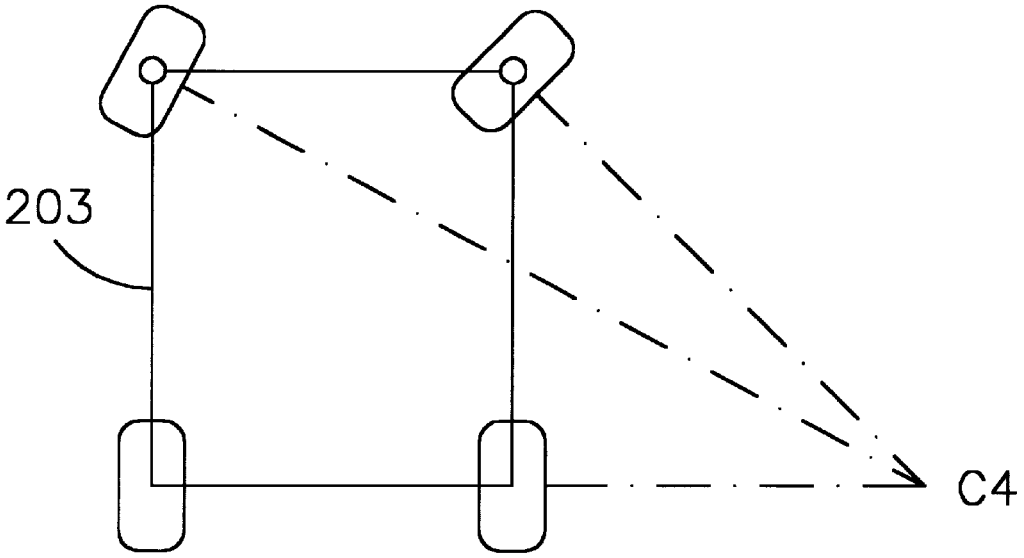
FIG. 20 shows the steering of a four-wheeled vehicle.

Conventional four-wheeled skateboards have two axles which each mount two wheels like vehicle schematic 202 in FIG. 19. For this case each axle is steered (not each wheel), and the geometrical analysis is similar to that of the two-wheeled case above with lines intersecting at point C3. Other typical four-wheeled vehicles, such as the automobile, have two unsteered wheels which share a common axis of rotation (not unlike the tricycle). The other two wheels are both steered and generally arranged such that all four wheels occupy the corners of a rectangle as depicted by vehicle schematic 203 in FIG. 20. To analyze this configuration the steering of each wheel is examined. Assume one wheel is steered an arbitrary amount. The line drawn through the rotation axis of this wheel will intersect the line of the common rotation axis of the two fixed wheels at point C4. This is just like the tricycle case so far. Now, however, we have a constraint on the second steered wheel. A line drawn through its rotation axis must intersect at that same point. The two steered wheels are thus dependent on each other in order to meet the steering requirement. Note that the steered wheels do not rotate the same amount about their respective steering axes. The inside wheel will tend to be turned a greater amount than the outside wheel. Fortunately, there exist mechanical linkage configurations which accommodate this dependency between the two steered wheels. In fact, it is fairly straight forward for someone skilled in the art of linkage design to approximately satisfy the steering requirement for the automobile for practical purposes. This is not necessarily the case for vehicles with increasing numbers of wheels.

Figure 21:
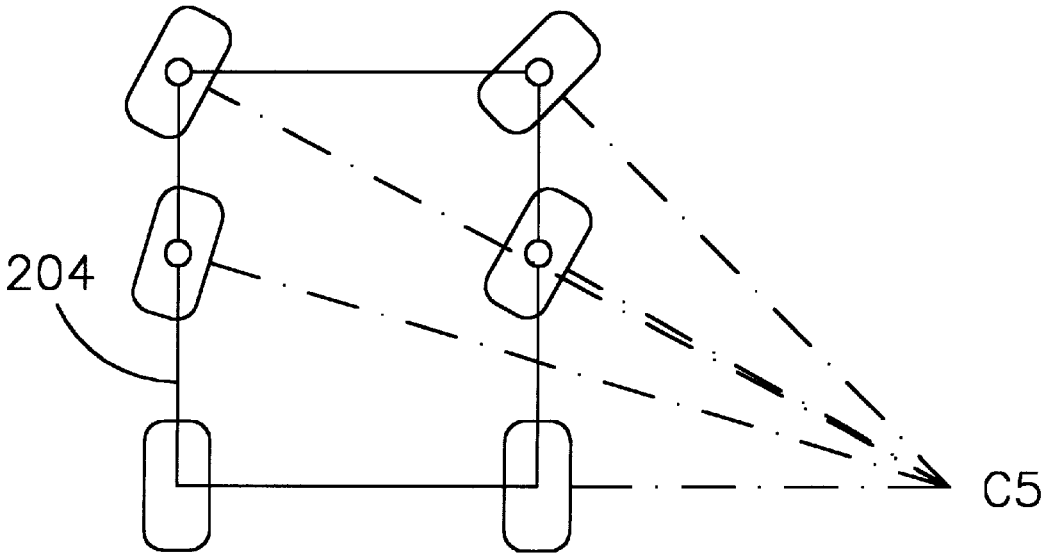
FIG. 21 shows the steering of a six-wheeled vehicle.

A six-wheeled vehicle might be of some interest. Assume that the basic configuration is similar to the four-wheeled case above. That is two of the wheels are unsteered and share a common rotation axis. Two steered wheels are added to form the corners of a rectangle as the configuration of the automobile. Referring to FIG. 21 two more steered wheels are then added at an intermediate location as shown by vehicle schematic 204 with one wheel on each side of the rectangle between a steered and unsteered wheel. Assume one wheel is steered an arbitrary amount. The line drawn through the rotation axis of this wheel will intersect the line of the common rotation axis of the two fixed wheels at a point C5. Now instead of one remaining wheel which has dependent motion there are three. Any three of the four steered wheels must have steering motion which is dictated by the fourth.

Designing a steering mechanism for this case is somewhat more challenging. To date there are no readily available examples of vehicles which satisfy the steering relationship depicted in FIG. 21. It is possible to use a linkage to solve, or at least approximate within practical limits, this steering problem. There are several dependencies of motion among the steered wheels. Increasing numbers of dependencies can be satisfied with increasing numbers of links. However, increasing the number of links also increases the difficulty of analyzing and evaluating a potential design. Increased numbers of links also add expense and difficulty to manufacture. The problem is compounded by the physical constraints associated with vehicle. That is the linkage must fit. The art of linkage design attempts to strike the best compromise between functionality and complexity. For a two-wheeled vehicle, there is no challenge; for a six-wheeled vehicle, the challenge is significant.

Figure 22:
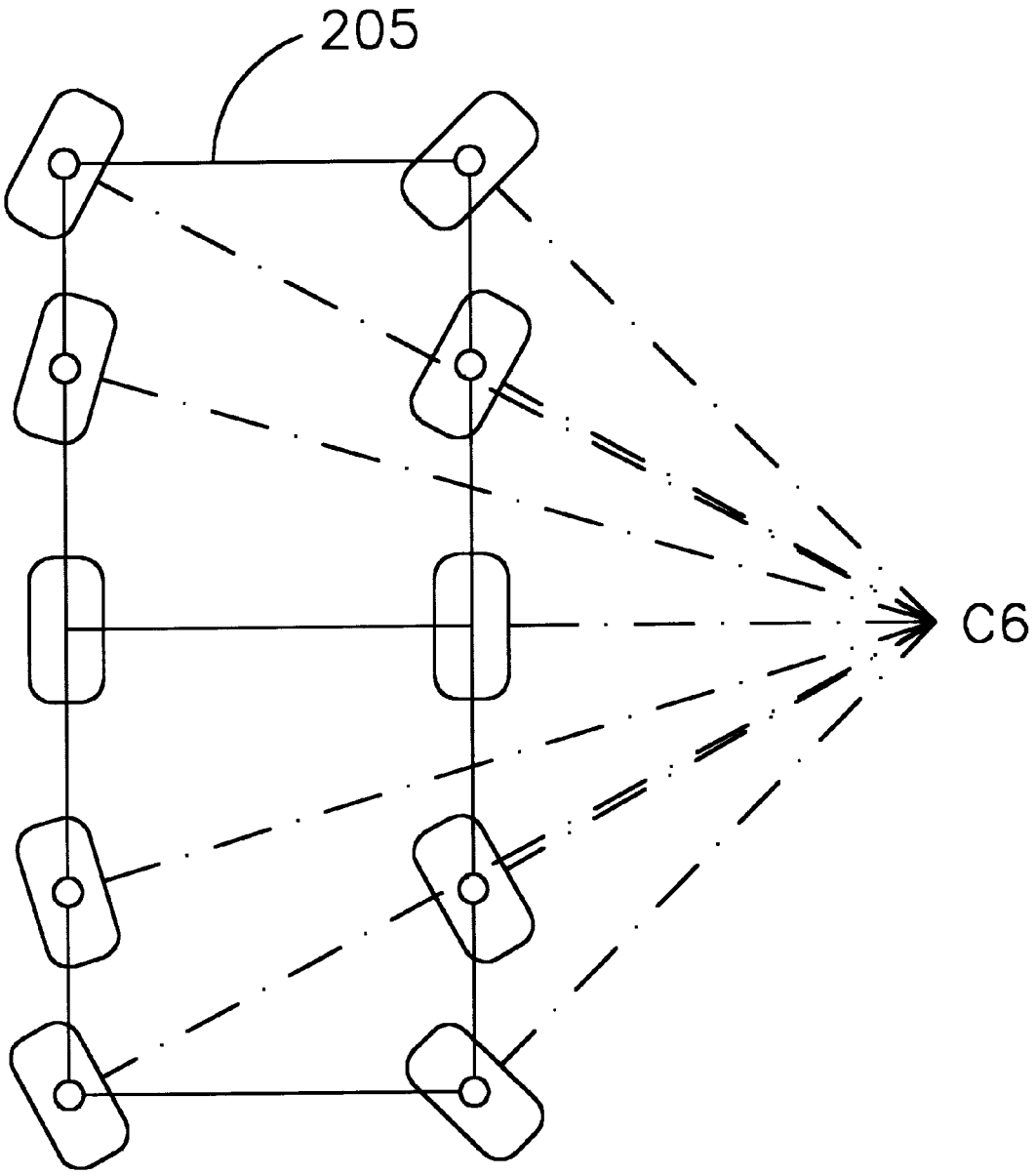
FIG. 22 shows the steering of a ten-wheeled vehicle.

The skateboard of the present invention features eight steered wheels as shown in FIG. 22 by vehicle schematic 205. The task of steering all eight wheels such that they meet the steering requirement (or approximately meet it for practical purposes) seems daunting at best. In fact, the problem can be simplified. The steering of the four front wheels is symmetric to the steering of the four rear wheels. A linkage designed for steering one set of four wheels is essentially a mirror image of the linkage that steers the other set provided an appropriate means is used to connect the two linkages. It turns out that the plane of symmetry between the linkages necessarily intersects the point at which the lines drawn through the rotation axes of all eight wheels converge designated point C6. This plane is orthogonal to the riding surface and intersects it in a line. Now we have four steered wheels and a line or axis which intersects the common point of intersection of the four rotation axes of the wheels. This is identical to the six-wheeled configuration of FIG. 21. As shown in FIG. 22 an additional set of unsteered wheels may be added to the eight steered wheels such that the common axis of rotation lies in the plane of symmetry between the two sets of four steered wheels. The result is a ten-wheeled configuration.

Alternate embodiments

Figure 23:
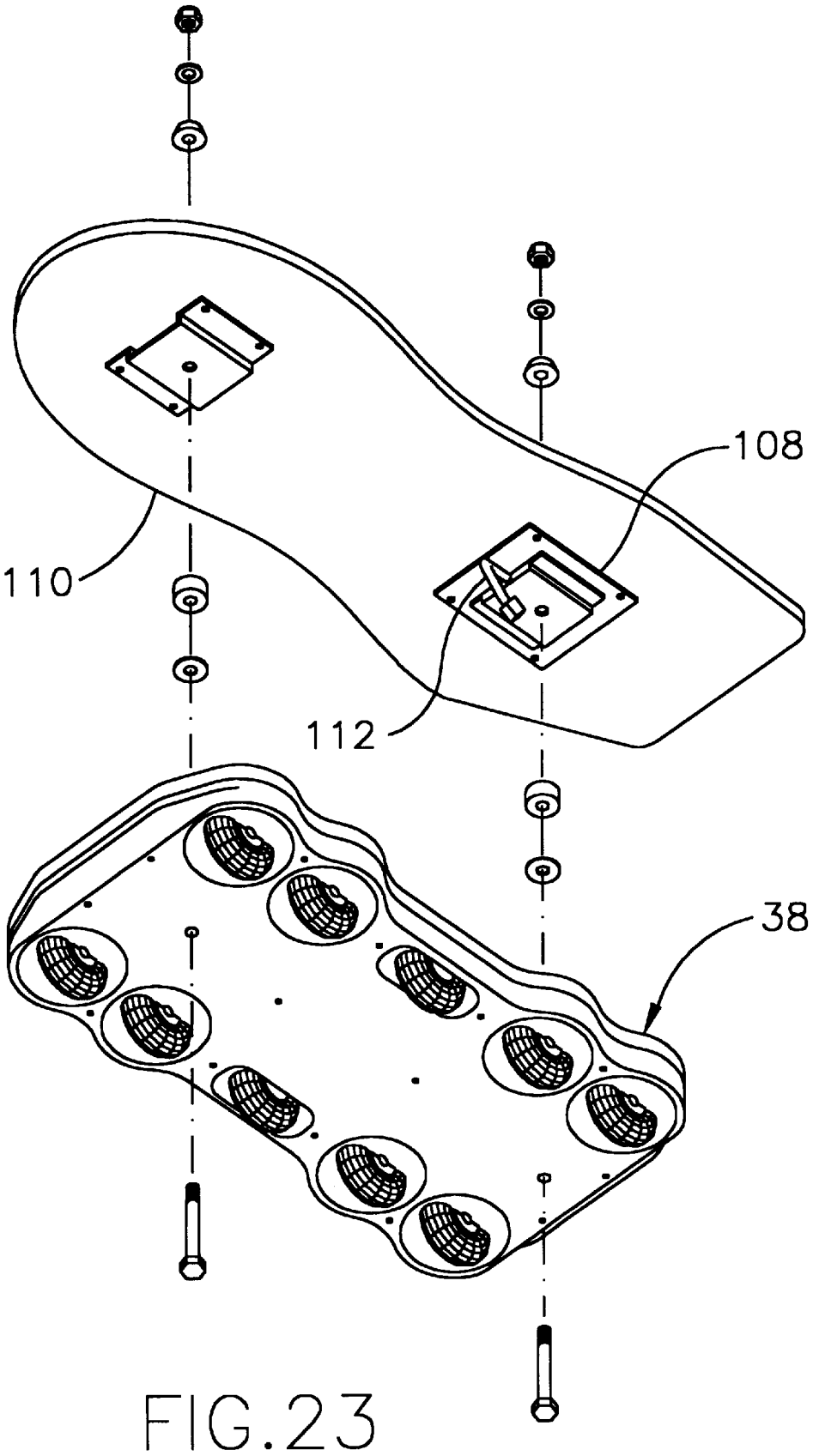
FIG. 23 shows a partially exploded view of a skateboard embodiment with ten wheels and fixed ratio steering.

Several variations of aspects of the preferred embodiment are shown in FIG. 23. Two wheels can be added to the skateboard without changing the internal workings. A ten-wheeled chassis 38 features recesses to accommodate the additional wheels. The recesses are in substantially the same location as the carrying handles of chassis 32. The mounting of the wheels to the chassis is substantially similar to the wheel mounting of the wheel housings shown in FIG. 14. FIG. 23 also shows the elimination of the variable ratio steering feature. A rear mounting plate 108 is shown with a steering arm 112 in a fixed position on the plate. The arm is welded or screwed in place on the plate and maintains a constant steering ratio. A deck 110 for fixed ratio steering allows mounting of plate 108 and is shown without break pads 60 of the preferred embodiment.

Conclusion, Ramifications, and Scope

The preceding discussion shows that the skateboard of the present invention has several advantages over other designs. The use of multiple wheels mounted in a substantially rigid chassis redundantly supports the weight of the rider and makes the skateboard faster and smoother-riding. Further, the unique multi-wheeled steering system of the skateboard provides enhanced maneuverability, allows greater stability at a range of speeds, and meets the requirements for consistent steering.

While the above description contains many specific details, these should not be construed as limitations on the scope of the invention, but rather as an exemplification of preferred embodiments thereof. Many other variations are possible. For example, the wheel housing gaskets can be of alternate construction or omitted entirely; the foot actuator can be a lever instead of a sliding part; the actuator can be spring loaded to return the steering arm to a desired position; the actuator could also have several indexed positions at which a mechanism holds the arm in place; the deck could be of alternate shape including a shape that is bi-directional; the wheels could have a flatter surface more like conventional skateboard wheels, and the wheels could be mounted to their respective housings with a slight rearward offset to allow the caster effect. Also, the essence of the present invention may be used in other applications. For instance heavy equipment such as forklifts are often limited in load carrying capability by the limited number of wheels. Being able to use up to ten wheels in a vehicle that can be turned in a relatively tight radius would be a great advantage. The steering linkage of the present invention allows this to be possible. Other vehicles benefiting from an increased number of wheels would also be obvious uses for the steering linkage.

Accordingly, the scope of the invention should be determined not by the embodiments illustrated or the examples given, but by the appended claims and their legal equivalents.

I claim:

1. A skateboard comprising:

a) a riding platform adapted to support a rider standing on a top surface of said platform;

b) a substantially rigid, mom-frame, non-pivoting chassis;

c) platform taunting means for mounting said chassis onto a bottom surface of said platform opposite said top surface;

d) a plurality of wheels adapted to support of skateboard on a substantially horizontal surface, each wheel of said plurality of wheels having a rolling rotation axis and vertical axis or projecting said rolling rotation axis onto a plane that intersects a center axis of turn, said plurality of wheels comprising a subset of wheels, said subset comprising at least two wheels of said plurality of wheels and at most all wheels of said plurality of wheels;

e) chassis mounting means for rotationally mounting said plurality of wheels onto said chassis whereby said each wheel of said plurality of wheels is enabled to roll on said horizontal surface;

f) a steering means operable by said rider for steering each wheel of said subset of wheels enabling said each wheel of said plurality of wheels to roll around substantially the same center axis of turn for a turning radius selected from a range of turning radii, said center axis being substantially vertical to said horizontal surface when said skateboard is supported by said plurality of wheels on said horizontal surface.

2. The skateboard of claim 1 wherein said plurality of wheels comprises two groups of wheels, one group of wheels being arranged with one another along a line proximal to one edge of said skateboard and another group of wheels being arranged to one another along a line proximal to another edge of said skateboard parallel to said one edge, each group of said two groups of wheels comprising at least three individual wheels.

3. The skateboard of claim 2 wherein:

a) said platform mounting means is constructed to permit a tilting of said platform with respect to said chassis;

b) said steering means is responsive to an angle of tilt between said top surface of said platform and said center axis of turn, whereby said rider is enabled to steer said skateboard by selecting said angle of tilt while riding said skateboard.

4. The skateboard of claim 3 wherein:

a) said chassis mounting means comprises:

1) an individual wheel housing for said each wheel of said subset of wheels;

2) wheel mounting means for rotationally mounting said each wheel of said subset of wheels onto each respective said wheel housing, whereby said each wheel of said subset of wheels is enabled to roll on said horizontal surface;

3) housing mounting means for rotatably mounting said each wheel housing onto said chassis with a rotation axis substantially perpendicular to said rolling rotation axis of each respective said wheel of said subset of wheels and approximately parallel to said center axis of turn.

b) said steering means comprises:

1) a plurality of substantially rigid link members;

2) a joining means for operably interconnecting said link members, said individual wheel housings, said chassis, and said platform, whereby said tilting of said platform with respect to said chassis results in a rotational motion of said each wheel housing, whereby said rotational motion enables said each wheel of said plurality of wheels to roll around approximately the said same center axis of turn for said turning radius within said range of turning radii.

5. The skateboard of claim 4 wherein:

a) said individual wheel housings are collectively associated into a forward group of housings mounted on a forward end of said chassis and a rearward group of housings mounted on a rearward end of said chassis;

b) said plurality of substantially rigid link members comprises:

1) a front input link rotatably mounted on said forward end of said chassis;

2) a rear input link rotatably mounted on said rearward end of said chassis;

3) a transfer link having one end rotatably secured to said front input link and another end rotatably secured to said rear input link;

4) an individual forward connecting link for each housing of said forward group of housings having one end rotatably secured to the respective said housing of said forward group of housings and another end rotatably secured to said front input link;

5) an individual rearward connecting link for each housing of said rearward group of housings having one end rotatably secured to the respective said housing of said rearward group of housings and another end rotatably secured to said rear input link;

c) said joining means comprises engagement means for operable engagement between said platform and one of said rear input link and said front input link enabling said tilting of said platform to orient one of said rear input link and said front input link, whereby said each wheel of said subset of wheels is steered.

6. The skateboard of claim 5 wherein said steering means includes selecting means operable by said rider while riding said skateboard for selecting a desired steering ratio within a range of steering ratios.

7. The skateboard of claim 6 wherein said selecting means comprises a foot actuator constructed to slide along a line substantially coplanar with said top surface of said platform and being operably coupled to said plurality of substantially rigid link members, whereby said rider selects said desired steering ratio with a foot of said rider.

8. The skateboard of claim 1 wherein:

a) said platform mounting means is constructed to permit a tilting of said platform with respect to said chassis;

b) said steering means is responsive to an angle of tilt between said top surface of said platform and said center axis of turn, whereby said rider is enabled to steer said skateboard by selecting said angle of tilt while riding said skateboard.

9. The skateboard of claim 8 wherein said plurality of wheels comprises at least eight individual wheels.

10. The skateboard of claim 8 wherein said steering means includes selecting means operable by said rider while riding said skateboard for selecting a desired steering ratio within a range of steering ratios.

11. The skateboard of claim 1 wherein said subset of wheels comprises at least eight individual wheels.

12. A skateboard comprising:

a) a riding platform adapted to support a rider standing on a top surface of said platform;

b) a plurality of wheels adapted to support said skateboard on a substantially horizontal surface, each wheel of said plurality of wheels having a rolling rotation axis and a vertical axis for projecting said rolling rotation axis onto a plane that intersects a center axis of turn, of said plurality of wheels comprising a subset of wheels, said subset comprising at least one wheel of said plurality of wheels and at most all wheels of said plurality of wheels;

c) wheel mounting means for rotationally mounting said plurality of wheels onto said platform whereby said each wheel of said plurality of wheels is enabled to roll on said horizontal surface;

d) a steering means operable by said rider for steering each wheel of said subset of wheels enabling said each wheel of said plurality of wheels to roll around substantially the same center axis of turn for a turning radius selected from a range of turning radii, said center axis being substantially vertical to said horizontal surface when said skateboard is supported by said plurality of wheels on said horizontal surface, said steering means comprising a selecting means operable by said rider while riding said skateboard for selecting a desired steering ratio within a range of steering ratio associated with said steering means said selecting means comprising a variable ratio steering unit operably connecting said riding platform and said subset of wheels.

13. The skateboard of claim 12 wherein:

a) said wheel mounting means is constructed to permit a tilting of said platform with respect to said center axis of turn;

b) said steering means is responsive to an angle of tilt between said top surface of said platform and said center axis of turn, whereby said rider is enabled to steer said skateboard by selecting said angle of tilt while riding said skateboard.

14. The skateboard of claim 13 wherein said selecting means further comprises a foot actuator constructed to slide along a line substantially coplanar with said top surface of said platform and being operably coupled to said subset of wheels, whereby said rider selects said desired steering ratio with a foot of said rider while riding said skateboard.

15. The skateboard of claim 13 wherein said plurality of wheels comprises at least eight individual wheels.

16. A method of riding and steering a skateboard which comprises the steps in operable order:

a) placing said skateboard having a plurality of wheels on a substantially horizontal surface with said wheels on said surface;

b) standing with one foot on a riding platform of said skateboard and another foot on said horizontal surface and pushing with said another foot to propel said skateboard;

c) placing said another foot on a position able actuator mounted on said platform and operably connected to said plurality of wheels by a variable ratio steering unit and a steering linkage in combination for establishing independent turning radii of each said wheel, d) positing said actuator with said another foot to obtain a desired steering ratio associated with said variable ratio steering unit;

e) steering said skateboard by leaning such as to tilt said platform relative to a plane defined by said wheels contacting said horizontal surface.

17. The method of riding and steering a skateboard of claim 16 wherein positioning said actuator is accomplished using a sliding motion of said another foot.

18. A land vehicle comprising:

a) a substantially rigid, mono-frame, non-pivoting chassis;

b) a plurality of wheels adapted to support said chassis on a substantially horizontal surface, said plurality of wheels comprising one of one subset and two subsets of wheels, each subset of said one subset and said two subsets comprising four individual wheels;

c) an individual wheel housing for each said wheel in said one of said one subset and said two subsets of wheels;

d) housing mounting means for rotatably mounting each said wheel housing onto said chassis with a rotation axis approximately perpendicular to a plane defined by said plurality of wheels contacting said horizontal surface;

e) wheel mounting means for rotationally mounting said each wheel of said one of said one subset and said two subsets of wheels onto the respective said wheel housing and for rotationally mounting each wheel of said plurality of wheels additional to said wheels of said one of said one subset and said two subsets of wheels onto said chassis whereby each wheel of said plurality of wheels is enabled to roll on said horizontal surface;

f) a steering said each wheel of said one of said one subset and said two subsets of wheels enabling said each wheel of said plurality of wheels to roll around substantially the same center axis of turn for a turning radius selected from a range of turning radii, said center axis being substantially vertical to said plane defined by said plurality of wheels contacting said horizontal surface, said steering means comprising:

1) a substantially rigid input link for said each subset of wheels, said input link being rotatably mounted onto said chassis;

2) a substantially rigid transfer link for said two subsets of wheels in combination, said transfer link having one end rotatably secured to one said input link and another end rotatably secured to another said input link;

3) a substantially rigid, individual connecting link for said each wheel housing having one end rotatably secured to the respective said wheel housing and another end rotatably secured to one of said input links, whereby rotation of one of said one input link and said another input link steers said wheels in said subsets of wheels.

19. The land vehicle of claim 18 wherein said land vehicle is a skateboard further including:

a) a riding platform adapted to support a rider standing on a top surface of said platform;

b) platform mounting means for mounting said chassis onto a bottom surface of said platform opposite said top surface, said platform mounting means constructed to permit tilting of said platform with respect to said chassis;

c) a coupling means for operably coupling said platform and said one of said one input link and said another input link, whereby said tilting of said platform results in rotation of said one of said one input link and said another input link whereby said wheels in said subsets of wheels are steered.

20. The skateboard of claim 19 wherein said coupling means comprises a selecting means operable by said rider while riding said skateboard for selecting a desired steering ratio within a range of steering ratios.

* * * * *